United States Patent [19]

Warren

[11] Patent Number: 5,070,896

[45] Date of Patent: Dec. 10, 1991

[54] PORTABLE APPARATUS FOR CONTAINING AND REGULATING FLOW OF A LIQUID INTO A DRAINAGE INLET

[76] Inventor: Richard E. Warren, 48 Stumpfield Rd., Kensington, N.H. 03827

[21] Appl. No.: 552,779

[22] Filed: Jul. 13, 1990

[51] Int. Cl.[5] ..... F16K 3/00

[52] U.S. Cl. ..... 137/1; 137/172; 137/362

[58] Field of Search ..... 137/172, 362, 590, 397, 137/399; 251/144

[56] References Cited

U.S. PATENT DOCUMENTS

| | | | |
|---|---|---|---|
| 1,204,052 | 11/1916 | Mohr | 137/397 X |
| 3,889,706 | 6/1975 | Wallin | 137/172 |
| 4,123,238 | 1/1979 | Clark | 137/172 |

*Primary Examiner*—Alan Cohan

*Attorney, Agent, or Firm*—Davis, Bujold & Streck

[57] ABSTRACT

An apparatus for containing a spill and regulating the flow of a liquid into a drainage inlet comprise a flange for engaging the opening of the drainage inlet and a sidewall extending from the flange, the sidewall defining a pair of drainage openings therein adjacent the flange and a movable member is positionable in the drainage openings for preventing the flow of the liquid into the drainage inlet through the drainage openings, the movable member can be opened progressively from adjacent the flange to allow a heavier density fluid, such as water, to flow into the drainage opening while maintaining a lighter density fluid, such as oil, floating on the surface of the mixture that collects around the apparatus and thereby prevents entry of the oil into the drainage inlet.

18 Claims, 2 Drawing Sheets

PORTABLE APPARATUS FOR CONTAINING AND REGULATING FLOW OF A LIQUID INTO A DRAINAGE INLET

The present invention relates to a portable apparatus for containing and regulating the flow of a liquid into a storm drain, sewer pipe or the like.

BACKGROUND OF THE INVENTION

When spillage of oil, gasoline or other similar materials occurs on land, the contaminant often escapes into storm drains which can result in costly clean-up, contamination of navigable water ways, underground contamination, the presence of explosive vapors in the storm drain system and possible threats to human health and the environment. Such spills often occur when a tanker truck is involved in an accident and its container compartment ruptures spilling its liquid contents into the environment or when a stationary storage container ruptures for some reason. If the spill is a "contained" spill, i.e. not able to flow into the drainage system, the contaminant or other spilled fluid is typically sprayed with water to "float" as much spilled contaminant as possible from the surface of the ground to minimize absorption. Thereafter, a recovery vehicle can vacuum up as much of the spilled contaminant and water as possible. However, as is often the case, the spill is an "uncontained" spill and the contaminant flows, via gravity, toward and into a drainage opening, such as a storm drain or sewer pipe, where it escapes directly into the sewer system without any treatment. The flow rate of the contaminant may be increased when the contaminant is mixed with water such as from rain, hail or melting snow. It is possible to prevent the contaminant and the water from entering the sewer system by forming a dam with sand bags or the like around the inlet of the storm drain. However, such procedure is time consuming, labor intensive and not practical in all instances.

Wherefore, it is a primary object of the invention to provide a flow regulator for a drainage inlet which allows a liquid contaminant and water to collect around the drainage inlet so that the contaminant can be easily recovered.

A further object of the invention is to provide a device which is relatively simple to manufacture and operate and performs satisfactorily in collecting a liquid contaminant.

A still further object of the invention is to provide a device which allows, once a sufficient quantity of a liquid mixture has collected, the heavier density fluid (e.g. the water) to flow into a drainage inlet while maintaining the lighter density liquid (e.g. the contaminant) floating on the surface of the collected mixture.

The above and other objects of the invention will become apparent to those skilled in the art once the invention is better understood.

SUMMARY OF THE INVENTION

The present invention relates to an apparatus for containing a spill and regulating the flow of a liquid into a drainage inlet, said apparatus comprising flange means for engaging an opening of a drainage inlet, a sidewall extending from said flange means and defining at least one drainage opening therein adjacent said flange means and a movable member being positionable in the at least one drainage opening for preventing the flow of a liquid into the drainage inlet through the at least one drainage opening, wherein said movable member opens progressively from adjacent said flange portion so that, when said apparatus is positioned over a drainage inlet and a mixture of at least two liquids of different densities collects therearound, the apparatus allows a heavier density liquid to flow into the drainage opening while maintaining a lighter density liquid floating on the surface of the heavier density liquid and prevents its entry into the drainage inlet.

BRIEF DESCRIPTION OF THE DRAWING

The invention will now be described, by way of example, with reference to the accompanying drawings, in which:

Turning now to FIG. 1, the flow control device or apparatus 2 of the present invention will now be described in detail. The apparatus 2 comprises a base member 4 having a flange 5, defining an opening 3 therein, with one surface for engaging a drainage inlet, and a pair of sidewalls 6, 8 (see FIG. 2). The shape and size of the flange member 5 can vary, depending on the type and size of drainage inlet to be engaged by the base member 4, and may be, for example, rectangular, square, oval or circular. In the embodiment shown in FIG. 1, the flange 5 and the member 4 both have a rectangular shape. The pair of opposed sidewalls 6, 8 extend substantially normal to the flange 5 from the inner perimeter thereof defining the opening 3. The height of the sidewalls 6, 8 can vary, depending on the application, but is anticipated that the sidewalls will have a height from about 10" to about 18", preferably about 12". As can be seen in FIG. 2, the two sidewalls 6, 8 each extend less than half way around the inner perimeter of flange 5 so that the two end edges 7 of sidewall 6 are spaced apart from the two end edges 9 of sidewall 8 to define valve openings 22 therebetween, the purpose of which will be described hereinafter.

Figure 1:
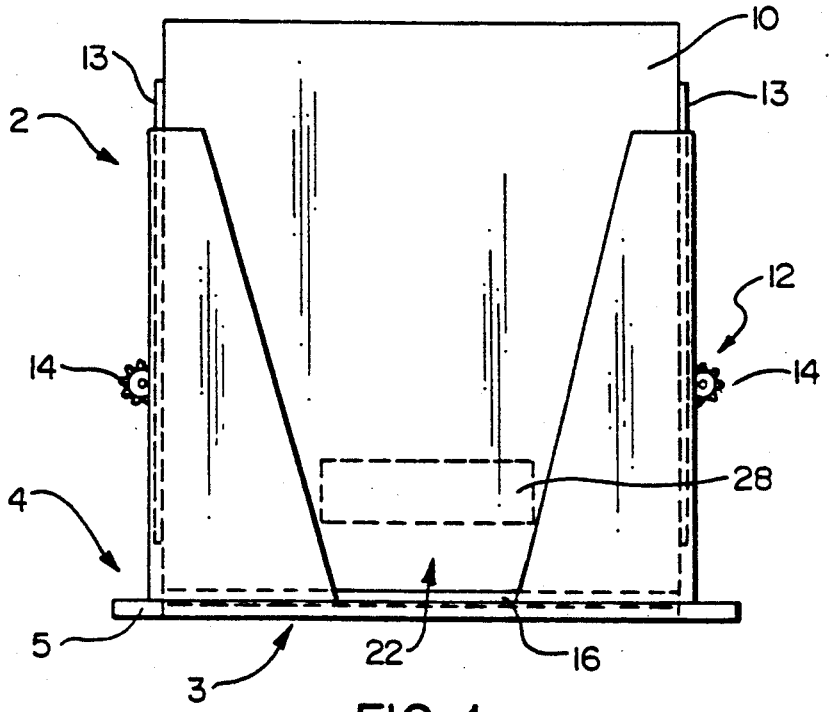
FIG. 1 is a diagrammatic front elevation of a flow control apparatus according to the present invention.
Figure 2:
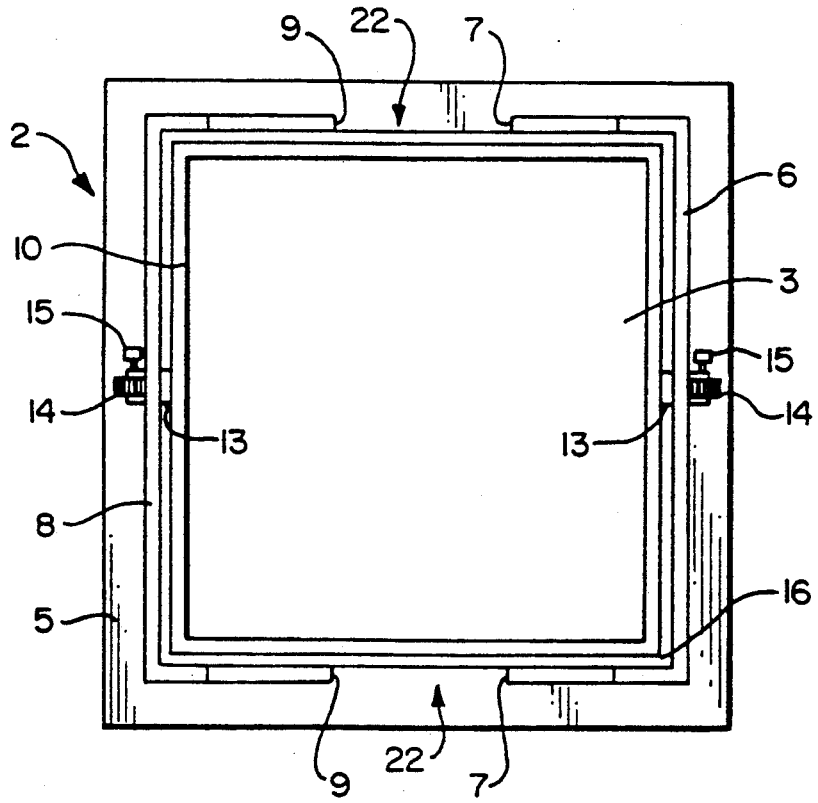
FIG. 2 is a plan view of the flow control apparatus shown in FIG. 1.

A movable insert member 10 has an identical shape (e.g. rectangular, square, oval or circular) to that of the sidewalls 6, 8 of the base member 4 but is slightly smaller in size so as to be closely received within the inner sidewalls 6, 8 of the base member 4 and being movable relative thereto by conveying means 12 to control the flow of liquid through the valve openings 22. It is anticipated that the conveying means 12 will be a rack and pinion arrangement comprising a pair of opposed racks 13 being fixedly carried on the outer walls of the movable member 10 while the pinion 14 is pivotably supported by the sidewalls 6 and 8 and arranged to engage the rack 13. A handle 15 is connected to each pinion 14 by a shaft so that simultaneous rotation of the two handles 15 causes movement of the movable member 10 relative to the base member 4. A brake arrangement (not shown) can be provided for assuring that the pinion arrangement does not rotate when movement is not desired. It is also to be appreciated that other types of known conveying means, such as a screw and nut arrangement, can also be employed for moving the movable member 10 relative to the base member 4. If desired, the entire outer perimeter of the movable member 10, located adjacent the flange 5, can be provided with sealing means 16, such as a rubber or foam gasket, to provide a seal therebetween and prevent any liquid from passing through the space between the movable member 10 and the inner sidewalls 6, 8 when in the movable member 10 is at its lowest position shown in FIG. 1. Fastening means 18 (see FIG. 3), supported by the flange 5 of the base member 4, are provided for securing the device 2 in position adjacent the inlet of a sewer pipe with the bottom surface of the flange 5 engaging the inlet so that the apparatus is positioned to control and regulate the flow of fluid into the drainage opening. The fastening means can comprise weighted sidewalls and flange members of the apparatus 2, added weights 18' which are placed on top of flange 5 or a pair of clamps (not shown) for engaging the inner surface of the storm drain 20 and securely positioning the apparatus. It is to be appreciated that, in a preferred embodiment, the outer perimeter of the flange 5 is substantially the same size as the cover of the storm drain which has been removed so that the flange 5 will be recessed within the opening of the storm drain (see FIG. 3) and this will prevent any lateral movement of the apparatus relative to the storm drain opening.

Figure 3:
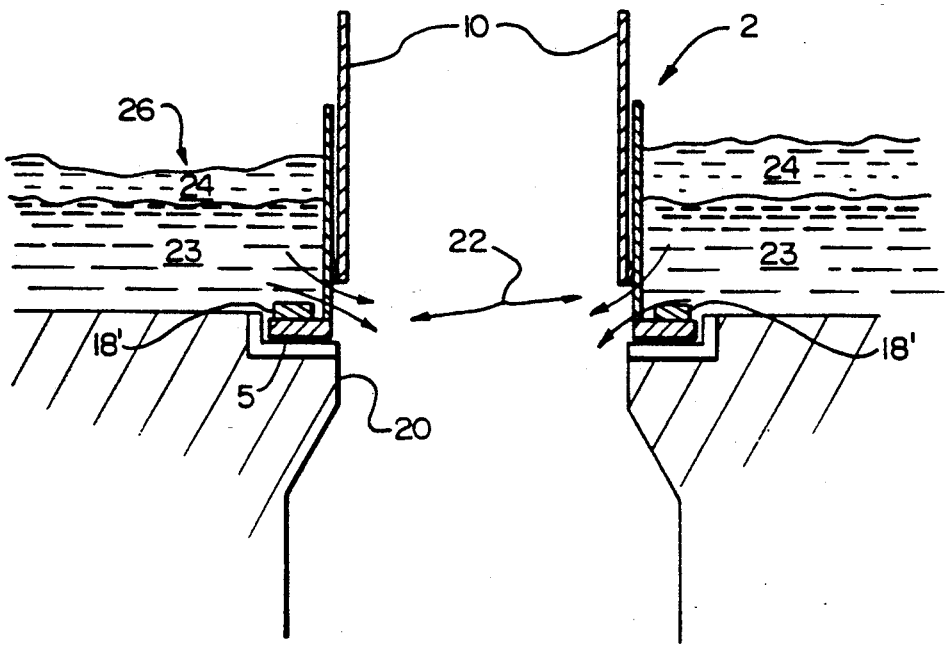
FIG. 3 is a diagrammatic elevation, partly in section, showing use of the flow control apparatus for collecting a contaminant while allowing drainage of water.

Turning now to FIG. 3, operation of the device will now be described in detail. When an oil or other liquid contaminant spill occurs, an emergency crew is called to the scene and they survey the area and locate the nearest storm drains or drainage inlets where the "uncontained" contaminant will flow. The drain covers of those drainage inlets are removed and an apparatus 2, according to the present invention, is installed in each of the openings and the fastening means 18 secures the apparatus 2 in position. Thereafter, the contaminant will collect around the apparatus and be contained. If the spill occurred in a paved area, such as a street or parking lot, the emergency crew can spray the contaminated area with water to wash the pave area and force the contaminant toward the apparatus. Alternatively, the contaminant may mix with rain water, if it is raining, or melting snow to form a mixture 26 which will flow, via gravity, toward the drainage inlets that are provided with the flow apparatus 2. The valves openings 22 of each apparatus is initially closed by the movable member 10 so that none of the contaminant or the mixture is allowed to enter into the drainage inlet. Thus, the contaminant or the water/contaminant mixture 26 will collect around the drainage inlet until a sufficient depth of fluid has gathered, i.e. about 3–7 inches or so. If only contaminant is collecting, the device acts solely as a barrier and prevents the contaminant form entering into the drainage inlet. If a contaminant/water mixture 26 is collecting around the device, the components of the mixture 26 will become eventually substantially static and begin to separate into layers because of their different densities. Thereafter, the movable member 10 can be raised relative to the base member 4, via the conveying means (not shown in FIG. 3), so that the valve openings 22 allow access of the heavier liquid adjacent the opening, i.e. the water, into the drainage pipe 20. As the contaminant, e.g. oil 24, has a lower density than the water 23, it floats on the surface of the water 23 which has collected in the vicinity of the apparatus 2. As the valve openings 22 open from the bottom upward, only water 23 is allowed access to the drainage inlet while the oil will continue to accumulate and float on the pooled mixture 26. By adjusting the position of the movable member 10 relative to the flange 5, the volume of water flowing through the valve openings 22 into the drain can be sufficiently controlled so that the quantity of pooled liquid, in turn, can be controlled. In both situations, the liquid which is prevented from entering the drainage inlet, i.e. the contaminant alone or the mixture, is then collected and appropriately treated and disposed.

If desired, floatation means 28 (shown in ghost in FIG. 1) can be attached to or formed into the outer periphery of the movable member 10, at a distance spaced from the flange 5, so that the movable member 10 will automatically be raised and lowered by the floatation means 28, depending to the height of the pooled mixture 26, so that automatic flow regulation into the drainage means through the valve openings 22 is achieved. With this arrangement, it is not necessary to have a separate conveying means 12 for adjusting the relative position of the movable member 10 to the base member 4.

Figure 4:
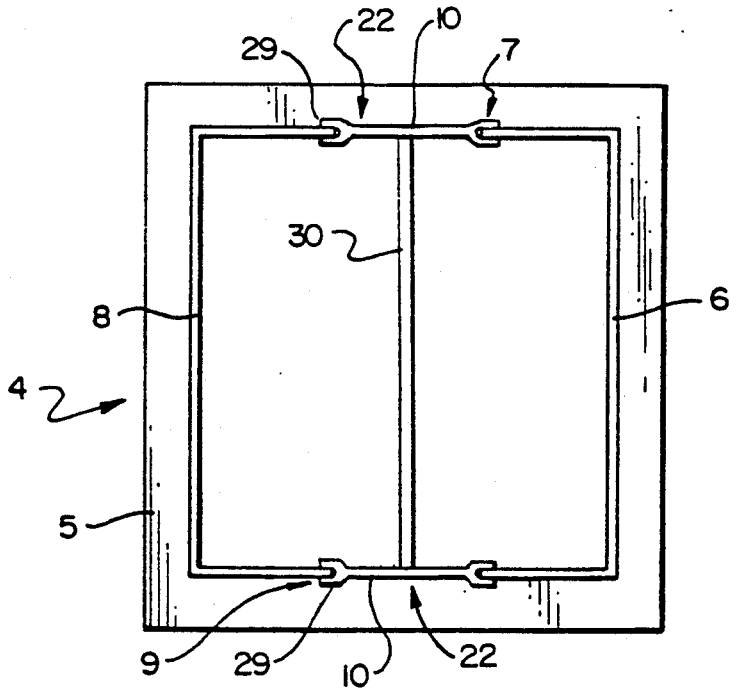
FIG. 4 is a plan view of a further embodiment of the invention.

Turning now to FIG. 4, a second embodiment of the invention is shown. This embodiment functions similarly to that discussed above, the only difference being that the movable member and base member have been formed as a single component. The base member 4 has a pair of opposed sidewalls 6, 8 which extend substantially normal to flange 5. The two end edges 7, 9 of the sidewalls 6, 8, respectively, extend substantially perpendicular and form two valve openings 22 therebetween in the sidewalls. A movable member 10, provided with U-shaped grooved end edges 29, engages the end edges 7, 9 of the sidewalls for allowing the movable member 10 to move relative thereto. When the movable member is moved away from the flange 5, it defines the opening 22 for providing access to drainage means when the apparatus is suitably connected. In this embodiment, an attachment member 30 can interconnect the top portion of each movable member 10 to provide a simultaneous movement of the two movable members relative to the base member 4. In addition, the U-shaped grooved end edges 29 can be made of plastic and have a interference fit with the end edges 7, 9 of the sidewalls so that the movable members 10 will remain at any position to which they are moved.

If desired, the device may be equipped with a sensor, such as a petroleum/water sensor, and a motorized valve(s) so that the apparatus could automatically contain a spill while allowing water to flow into the drainage inlet. It is anticipated that the apparatus can be manufactured from stainless steel, brass, cast iron, aluminum, or other metals that resists corrosion when subjected to water and are compatible with the substance to be contained. In addition, the apparatus can be manufactured from a durable plastic material such as polyethylene or the like.

Since certain changes can be made in the above described regulator apparatus, without departing from the spirit and scope of the invention herein involved, it is intended that all subject matter contained in the above description or shown in the accompanying drawings shall be interpreted as being illustrative of the invention and not limiting thereof.

Wherefore I claim:

1. An apparatus for containing a spilled of a petroleum liquid and a heavier density liquid and regulating the flow of the heavier density liquid into a storm drain, having a drainage inlet with a recess area extending about the perimeter of the drainage inlet, while minimizing the flow of the petroleum liquid into the storm drain, said apparatus comprising:

flange means, defining a central opening therein, for engaging the recess area of the storm drain, said flange means being substantially the same size and shape as a cover of the storm drain so that when the cover is removed from the storm drain, said flange means may be supported within the storm drain recess area to locate the apparatus and prevent lateral movement thereof relative to the drainage inlet;

a sidewall extending substantially normal from one surface of said flange means, adjacent the central opening, defining at least one sidewall opening therein adjacent said flange means;

a hollow member, movable relative to the sidewall, to control the flow of liquid through the at least one sidewall opening of the apparatus, the movable hollow member, when in a first position located adjacent the flange means, preventing the flow of liquid through the at least one sidewall opening without obstructing the central opening, and the movable hollow member being progressively movable away from the first position to a second position, remote from the first position, to increase progressively a rate of flow of liquid through the at least one sidewall opening;

wherein when said apparatus is positioned over the drainage inlet of a said storm drain with the flange means received by the recess area, the apparatus prevents the flow of liquid into the storm drain when the movable member is in its first position and, once a sufficient quantity of liquid has collected about the apparatus and that liquid has become sufficiently static, the movable hollow member can be moved toward the second position a desired distance to allow the heavier density liquid to flow through the at least one sidewall and central openings of the apparatus into the drainage inlet, the position of the movable hollow member being controlled so that only the heavier density liquid is allowed to flow in the drainage inlet while the movable hollow member substantially prevents the petroleum liquid from flowing through the at least one sidewall opening into the drainage inlet.

2. An apparatus according to claim 1, wherein at least two sidewall openings are provided in the sidewall and a portion of the movable hollow member is associated with each sidewall opening.

3. An apparatus according to claim 2, wherein the movable hollow member is a separate member which is closely received by the sidewall.

4. An apparatus according to claim 3, wherein conveying means is provided for moving said movable hollow member relative to said flange means to control the flow of the liquid through the sidewall openings.

5. An apparatus according to claim 4, wherein said conveying means comprises a rack and pinion arrangement, the rack being carried by the movable hollow member and the pinion carried by the sidewall.

6. An apparatus according to claim 4, wherein said conveying means comprises a rack and pinion arrangement, the rack being carried by the sidewall and the pinion carried by the movable hollow member.

7. An apparatus according to claim 3, wherein said movable hollow member is provided with floatation means for moving said movable hollow member relative to the flange means to control the flow of liquid through the sidewall openings.

8. An apparatus according to claim 1, wherein said apparatus is manufactured from one of stainless steel, brass, cast iron and aluminum.

9. An apparatus according to claim 1, wherein said apparatus is manufactured from a durable plastic material.

10. An apparatus according to claim 9, wherein said plastic material is polyethylene.

11. An apparatus according to claim 3, wherein the sidewall comprises two separate sidewall members each extending less than half way around the flange means to define said two drainage openings therebetween.

12. An apparatus according to claim 1, wherein means are provided for fastening the flange means to the opening of a drainage inlet when in use.

13. An apparatus according to claim 2, wherein the movable member comprises a pair of movable members, each engaging one of said two drainage openings.

14. An apparatus according to claim 13, wherein the two movable members are connected to one another by an attachment member.

15. An apparatus according to claim 13, wherein the two movable members are provided with U-shaped grooved end edges which engage the end edges of the two separate sidewall members.

16. An apparatus according to claim 1, wherein the sidewall comprises a pair of opposed sidewalls extending substantially normal to the flange means adjacent the central opening, the opposed pair of sidewalls extending less than half way around the central opening so that end edges of one of the sidewalls are spaced from end edges of the opposed sidewall along their entire length to define two elongate sidewall openings therebetween.

17. An apparatus for containing a spilled of a petroleum liquid and a heavier density liquid and regulating the flow of the heavier density liquid into a storm drain, said apparatus being used in combination with a storm drain comprising a drainage inlet with a recess area extending about a perimeter of the drainage inlet, the drainage inlet channeling liquid to a sewer system, said apparatus comprising:

flange means, defining a central opening therein, for engaging the recess area of the storm drain, said flange means being substantially the same size and shape as a cover of the storm drain and being supported within the storm drain recess area, after removal of the cover of the storm drain, so as to be the sole means for locating the apparatus and preventing lateral movement thereof relative to the drainage inlet;

a sidewall extending substantially normal from one surface of said flange means, adjacent the central opening, defining at least one sidewall opening therein located adjacent said flange means;

a hollow member, movable relative to the sidewall, to control the flow of liquid through the at least one sidewall opening of the apparatus, the movable hollow member, when in a first position located adjacent the flange means, preventing the flow of liquid through the at least one sidewall opening without obstructing the central opening, and the movable hollow member being progressively movable away from its first position to a second position, remote from the first position, to increase progressively a rate of flow of liquid through the at least one sidewall and central openings;

wherein after positioning said apparatus over the drainage inlet of a said storm drain with the flange means received and supported by the recess area, the apparatus prevents the flow of liquid into the storm drain when the movable hollow member is in its first position and, once a sufficient quantity of liquid has collected about the apparatus and that liquid has become sufficiently static, the movable hollow member can be moved toward the second position a desired distance to allow the heavier density liquid to flow through the at least one sidewall and central openings of the apparatus into the drainage inlet, the position of the movable hollow member being controlled so that only the heavier density liquid is allowed to flow in the drainage inlet while the movable hollow member substantially prevents the petroleum liquid from flowing through the at least one sidewall opening into the drainage inlet.

18. A method of using an apparatus suitable for containing a mixture of spilled petroleum liquid and water and regulating the flow of water into a storm drain, having a drainage inlet with a recess area extending about a perimeter of the drainage inlet, while minimizing the flow of the petroleum liquid into the storm drain, said apparatus comprising, flange means, defining a central opening therein, for engaging the recess area of the storm drain, said flange means being substantially the same size and shape as a cover of the storm drain so that when the cover is removed from the storm drain, said flange means may be supported within the storm drain recess area to locate the apparatus and prevent lateral movement thereof relative to the drainage inlet, a sidewall extending substantially normal from one surface of said flange means, adjacent the central opening, defining at least one sidewall opening therein located adjacent said flange means, a hollow member, movable relative to the sidewall, to control the flow of liquid through the at least one sidewall opening of the apparatus, the movable hollow member, when in a first position located adjacent the flange means, preventing the flow of liquid through the at least one sidewall opening into the drainage inlet without obstructing the central opening, and the movable hollow member being progressively movable away from the first position to a second position, remote from the first position, to increase progressively a rate of flow of liquid through the at least one sidewall opening;

said method comprising the steps of:

positioning the apparatus over a storm drain with the flange means being received and supported by the recess area of the storm drain with the central opening overlying the drainage inlet;

allowing the mixture of petroleum liquid and water to collect around the apparatus;

controlling the position of the movable hollow member, relative to the flange means, to control the flow of water into the drainage inlet, through the sidewall and central openings, while maintaining the petroleum liquid floating on the water and preventing entry of the petroleum liquid into the at least one sidewall opening; and collecting the petroleum liquid after a sufficient quantity of water has been allowed to flow into the drainage inlet.

* * * * *